United States Patent [19]

Passmore

[11] Patent Number: 4,881,009

[45] Date of Patent: Nov. 14, 1989

[54] ELECTRODE FOR HIGH INTENSITY DISCHARGE LAMPS

[75] Inventor: Edmund M. Passmore, Gloucester, Mass.

[73] Assignee: GTE Products Corporation, Danvers, Mass.

[21] Appl. No.: 557,812

[22] Filed: Dec. 5, 1983

[51] Int. Cl.[4] ..... H01J 61/06

[52] U.S. Cl. ..... 313/631; 313/633; 313/346 R; 313/311

[58] Field of Search ..... 313/355, 633, 631, 632, 313/352, 346 R, 211

[56] References Cited

U.S. PATENT DOCUMENTS

| | | | |
|---|---|---|---|
| 3,148,981 | 9/1964 | Ryshkewitch | 428/547 |
| 4,092,560 | 5/1978 | Puska | 313/631 X |
| 4,155,758 | 5/1979 | Evans et al. | 313/636 X |
| 4,400,647 | 8/1983 | Palty | 313/352 X |
| 4,404,492 | 9/1983 | Palty | 313/352 X |

*Primary Examiner*—Joseph Golian

*Attorney, Agent, or Firm*—William H. McNeill; José W. Jimenez; Joseph S. Romanow

[57] ABSTRACT

Electrodes for lamps comprising elongated structures comprised of layers containing varying amounts of metal and refractory oxide. In a preferred embodiment the electrode has a first end comprising 9.6 volume percent tungsten or molybdenum and the remainder alumina. The second end comprises substantially 100% tungsten. The intermediate body contains layers of, e.g., 12, 20, 35, 50 and 75% tungsten.

6 Claims, 1 Drawing Sheet

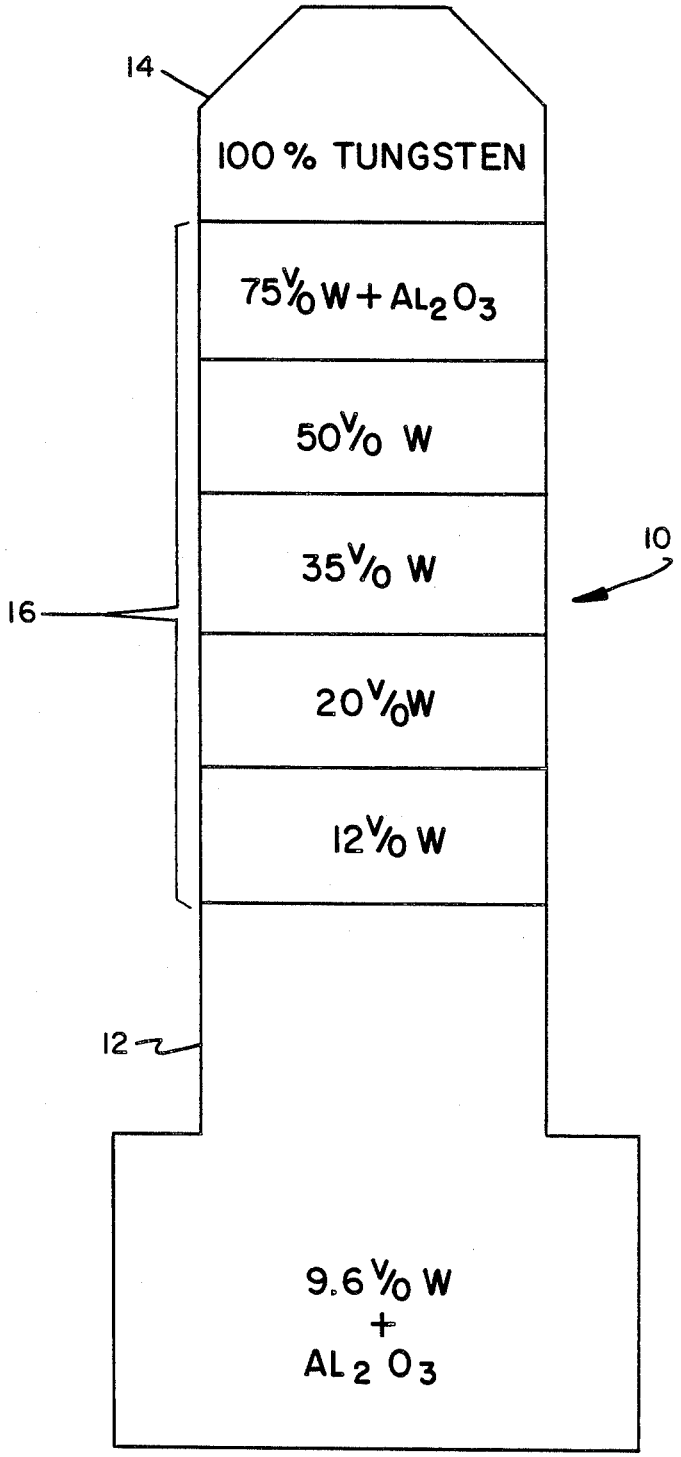
14
100 % TUNGSTEN
75 V/O W + AL2O3
50 V/O W
35 V/O W
10
16
20 V/O W
12 V/O W
12
9.6 V/O W
+
AL2O3

ELECTRODE FOR HIGH INTENSITY DISCHARGE LAMPS

CROSS REFERENCE TO CO-PENDING APPLICATION

A co-pending application entitled, "Electrode For High Intensity Discharge Lamps," with the method claims was filed on Dec. 5, 1983, having Ser. No. 557,813, now U.S. Pat. No. 4,822,312. The co-pending application has the same inventor and assignee as the present application.

TECHNICAL FIELD

This invention relates to articles of manufacture and more particularly to such articles which can be employed as electrodes in high intensity discharge lamps.

BACKGROUND ART

Some forms of high intensity discharge lamps, e.g., high pressure sodium lamps or metal halide lamps (e.g., Pat. Nos. 3,885,184; 3,911,308; 4,409,517), employ ceramic arc tubes constructed of polycrystalline alumina. These tubes have tungsten electrodes welded to niobium feedthrough which are sealed in a sealing disc of alumina; the discs, in turn, being sealed into the ends of the tube by means of a frit. Electrical connection is made to the ends of the feedthroughs which project from the sealing discs. This construction requires multiple hermetic seals and is quite costly and difficult.

It has been proposed that the feedthroughs be made of a conductive cermet having a tungsten electrode mounted therein. The cermet then serves as the electrical contact for the arc tube. See, e.g., U.S. Pat. No. 4,155,758. This procedure still requires some means for mounting the electrode within the feedthrough.

DISCLOSURE OF THE INVENTION

It is, therefore, an object of the invention to obviate the disadvantages of the prior art.

It is another object of the invention to provide a combination sealing disc and electrode.

These objects are accomplished, in one aspect of the invention, by an article of manufacture which is comprised of a mixture of a refractory oxide and a metal. The article has first and second ends separated by an intermediate body. The first end comprises a low volume percent of the metal and the second end comprises a high volume percent of the metal. The intermediate body comprises gradually increasing amounts of the metal in progression from the first end to the second end.

The article thus provides a single element having a gradual thermal expansion gradient between the first end and the second end. When employed as an electrode in an arc discharge lamp a single hermetic seal can be formed between the first end of the article and the discharge tube.

The article can be made by compacting the various layers in a die and subsequently firing.

BRIEF DESCRIPTION OF THE DRAWINGS

The single figure is a representational, sectional view of an article in accordance with an embodiment of the invention.

BEST MODE FOR CARRYING OUT THE INVENTION

For a better understanding of the present invention, together with other and further objects, advantages, and capabilities thereof, reference is made to the following disclosure and appended claims taken in conjunction with the above-described drawings.

Referring now to the drawing with greater particularity, the figure shows an article 10 which can be an electrode for a lamp; e.g., a high pressure sodium lamp. The article has a first end or base 12, a second end 14 and an intermediate body 16. The intermediate body 16 comprises gradually increasing amounts of the metal in progression from the first end 12 to the second end 14.

While the actual ratios of the metal to the refractory oxide may vary depending upon the end result desired, in a preferred embodiment they are as shown in the drawing and as described herein. Thus, the first end 12 comprises a substantially homogeneous mixture of 9.6 volume percent (v/o) tungsten or molybdenum with the remainder alumina ($Al_2O_3$). The intermediate body 16 in this embodiment comprises five layers of gradually increasing amounts of tungsten, viz.: 12, 20, 35, 50 and 75 v/o. The second end 14 comprises substantially 100% tungsten, which may comprise an emitter such as one to five (1–5%) percent thorium oxide. This construction provides an article 10, suitable for an electrode for a high pressure sodium lamp or a metal halide lamp. The first end has a thermal expansion coefficient of approximately $7.5\times10^{-6}/^{o}k$ while the second end has the thermal expansion of tungsten, $4.5\times10^{-6}/^{o}K$. The intermediate body has varying thermal coefficients which provide a gradual thermal expansion gradient between the first and second ends. The expansion coefficient of the first end closely matches that of alumina and thus allows easy sealing thereto.

While the drawings is shown greatly enlarged, a typical electrode constructed in accordance with the teachings herein could have a major diameter of about 3/16" and a minor diameter of ⅛". The overall length could be in the neighborhood of ½".

While it is possible to make the article in its finished dimensions, it may be preferable to fabricate it oversize and then machine to its final dimensions.

A preferred embodiment for making the article comprises forming the mixture for the first end by mixing the requisite amount of tunsten, such as grade M35 available from GTE Products Corporation, and minus 80 plus 100 mesh alumina granules, for example, in a rotating jar mill. The mixture is then loaded into a die and lightly compacted. Each successive layer is similarly mixed and added to the die, using a small amount of an aqueous solution of polyethylene glycol as a lubricant. The powders are again compacted and the final layer, comprising substantially 100% tungsten, is added. The assembly of layers is then cold pressed at from 10,000 to 20,000 psi and then removed from the die. The assembly is then presintered in wet hydrogen for about two hours at about 1050° C. and then sintered in dry hydrogen or vacuum for about four hours at about 1850° C.–1900° C.

Articles fabricated as herein described avoid many of the problems associated with prior art cermet constructions because the large discrepancy in thermal expansion between the tungsten electrode and the cermet is reduced.

They also enable the use of reactive metal halides such as the chlorides (U.S. Pat. Nos. 3,882,345; 4,027,190; 4,319,157 describe the use of metal chlorides in discharge lamps) which are limited in their application with conventional electrodes because of the rapid corrosion of the tungsten rod.

While there have been shown what are at present considered to be preferred embodiments of the invention, it will be apparent to those skilled in the art that various changes and modifications can be made herein without departing from the scope of the invention as defined by the appended claims.

I claim:

1. A high intensity discharge lamp electrode comprised of a mixture of a refractory oxide and a metal, said electrode having first and second ends separated by an intermediate body; said first end comprising a low volume percent of said metal and said second end comprising a high volume percent of said metal; said intermediate body comprising gradually increasing amounts of said metal in progression from said first end to said second end.

2. The electrode of claim 1 wherein said refractory oxide is alumina.

3. The electrode of claim 2 wherein said metal is tungsten or molybdenum or an alloy thereof.

4. The electrode of claim 3 wherein said first end comprises about 9.6 volume percent tungsten and said second end comprises about 100 volume percent tungsten, with 0–5 percent thorium oxide added as an emitter.

5. The electrode of claim 4 wherein said intermediate body comprises approximately five areas containing increasing volume percentages of tungsten.

6. The electrode of claim 5 wherein said five areas comprise in order, from said first end to said second end, volume percentages of tungsten of about 12; about 20; about 35; about 50; and about 75.

* * * * *